US009666147B2

(12) United States Patent
Park et al.

(10) Patent No.: US 9,666,147 B2
(45) Date of Patent: May 30, 2017

(54) DATA DRIVING APPARATUS PROVIDING DATA SIGNALS TO DATA LINES IN A DISPLAY APPARATUS

(71) Applicant: Samsung Display Co., Ltd., Yongin (KR)

(72) Inventors: Kee-Bum Park, Cheonan-si (KR); Kyung-Ho Kim, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 85 days.

(21) Appl. No.: 14/458,799

(22) Filed: Aug. 13, 2014

(65) Prior Publication Data

US 2015/0161960 A1 Jun. 11, 2015

(30) Foreign Application Priority Data

Dec. 5, 2013 (KR) ..... 10-2013-0150882

(51) Int. Cl.
*G09G 3/36* (2006.01)

(52) U.S. Cl.
CPC ... *G09G 3/3611* (2013.01); *G09G 2300/0408* (2013.01); *G09G 2300/0426* (2013.01); *G09G 2310/0281* (2013.01); *G09G 2310/0283* (2013.01)

(58) Field of Classification Search
CPC ..... G09G 3/3655; G09G 3/3611
See application file for complete search history.

(56) References Cited

U.S. PATENT DOCUMENTS

| | | | | |
|---|---|---|---|---|
| 7,630,048 | B2 | 12/2009 | Hong et al. | |
| 2005/0156840 | A1* | 7/2005 | Kim | G09G 3/3655 345/87 |
| 2005/0270266 | A1* | 12/2005 | Lin | G09G 3/3666 345/103 |
| 2007/0002005 | A1* | 1/2007 | Kim | G09G 3/3655 345/103 |
| 2009/0040166 | A1* | 2/2009 | Lee | G02F 1/1345 345/98 |
| 2010/0149141 | A1 | 6/2010 | Kim | |
| 2011/0128274 | A1 | 6/2011 | Kumagai et al. | |
| 2011/0134102 | A1* | 6/2011 | Lee | G09G 3/3655 345/212 |
| 2013/0093657 | A1 | 4/2013 | Song et al. | |

FOREIGN PATENT DOCUMENTS

| | | |
|---|---|---|
| KR | 10-0977734 | 8/2010 |
| KR | 1020130024163 | 3/2013 |

* cited by examiner

*Primary Examiner* — Kwang-Su Yang
(74) *Attorney, Agent, or Firm* — H.C. Park & Associates, PLC

(57) ABSTRACT

A data driving apparatus includes a first data driver and a second data driver. The first data driver is configured to generate data signals to data lines of a display panel, and includes data pads configured to output the data signals, a first common voltage pad configured to output a common voltage to the display panel, and a gate driving signal pad configured to output a gate driving signal to a gate driver, which is configured to output a gate signal to a gate line of the display panel. The second data driver is disposed between two first data drivers; is configured to generate the data signal provided to the data line; and includes a second common voltage pad configured to output the common voltage to the display panel. Thus, a width of a bezel of the display apparatus may be decreased.

17 Claims, 8 Drawing Sheets

DATA DRIVING APPARATUS PROVIDING DATA SIGNALS TO DATA LINES IN A DISPLAY APPARATUS

CROSS REFERENCE TO RELATED APPLICATION

This application claims priority from and the benefit of Korean Patent Application No. 10-2013-0150882, filed on Dec. 5, 2013, which is hereby incorporated by reference for all purposes as if fully set forth herein.

BACKGROUND

Field

Exemplary embodiments of the present disclosure relate to a data driving apparatus outputting a data signal to a data line of a display panel and a display apparatus having the data driving apparatus.

Discussion of the Background

A display apparatus, such as a liquid crystal display apparatus, includes a display panel, a gate driving part and a data driving part. The display panel displays an image, and includes a gate line transferring a gate signal and a data line transferring a data signal. The gate driving part outputs the gate signal to the gate line of the display panel. The data driving part outputs the data signal to the data line of the display panel.

A data fan-out line transferring the data signal outputted from the data driving part to the data line may be formed between the data driving part and the data line.

A gate driving signal pad, which outputs a gate driving signal driving the gate driving part, a common voltage pad, which outputs a common voltage to the display panel, and data pads, which output the data signals to the data driving part, may be formed in the data driving part to reduce a distance and a pitch of the data pads. Therefore, a distance between the data pads may be narrower than a distance between the data lines, and thus the data fan-out lines connect the data pads and the data lines in diagonal line shape, which is not parallel with the data line. Therefore, a length of the data fan-out line is increased, and thus a bezel of the display apparatus is increased.

The above information disclosed in this Background section is provided to enhance understanding of the background of the disclosed subject matter and therefore may contain information that does not form any part of the prior art nor what the prior art may suggest to a person of ordinary skill in the art.

SUMMARY

Exemplary embodiments of the present disclosure provide a data driving apparatus with a decreased size of a bezel.

Exemplary embodiments of the present disclosure also provide a display apparatus having the above-mentioned data driving apparatus.

Additional features of the present disclosure will be set forth in the description which follows, and in part will be apparent from the description, or may be learned by practice of the disclosed subject matter.

Exemplary embodiments of the present disclosure disclose a data driving apparatus including at least one first data driver and at least one second data driver. The at least one first data driver including data pads, at least one first common voltage pad, and a gate driving signal pad. The data pads provide first data signals to data lines of a display panel. The at least one first common voltage pad provides a common voltage to the display panel. The gate driving signal pad provides a gate driving signal to a gate driver configured to provide a gate signal to a gate line of the display panel. The at least one second data driver provides a second data signal to the data lines. The at least one second data driver includes at least one second common voltage pad configured to provide the common voltage to the display panel.

Exemplary embodiments of the present disclosure also disclose a display apparatus including a display panel, a gate driver, and a data driving apparatus. The data driving apparatus includes at least one first data driver and at least one second data driver. The display panel displays an image. The gate driver provides a gate signal to a gate line of the display panel. The at least one first data driver provides first data signals to data lines of the display panel. The at least one first data driver includes data pads to provide the first data signals, at least one first common voltage pad to provide a common voltage to the display panel, and a gate driving signal pad to provide a gate driving signal to the gate driver. The at least one second data driver provides second data signals to the data lines and includes at least one second common voltage pad to provide the common voltage to the display panel.

It is to be understood that both the foregoing general description and the following detailed description are exemplary and explanatory and are intended to provide further explanation of the disclosed subject matter as claimed.

BRIEF DESCRIPTION OF THE DRAWINGS

The accompanying drawings, which are included to provide a further understanding of the disclosed subject matter and are incorporated in and constitute a part of this specification, illustrate exemplary embodiments of the disclosed subject matter, and together with the description serve to explain the principles of the disclosed subject matter.

DETAILED DESCRIPTION OF THE ILLUSTRATED EMBODIMENTS

Figure 1:
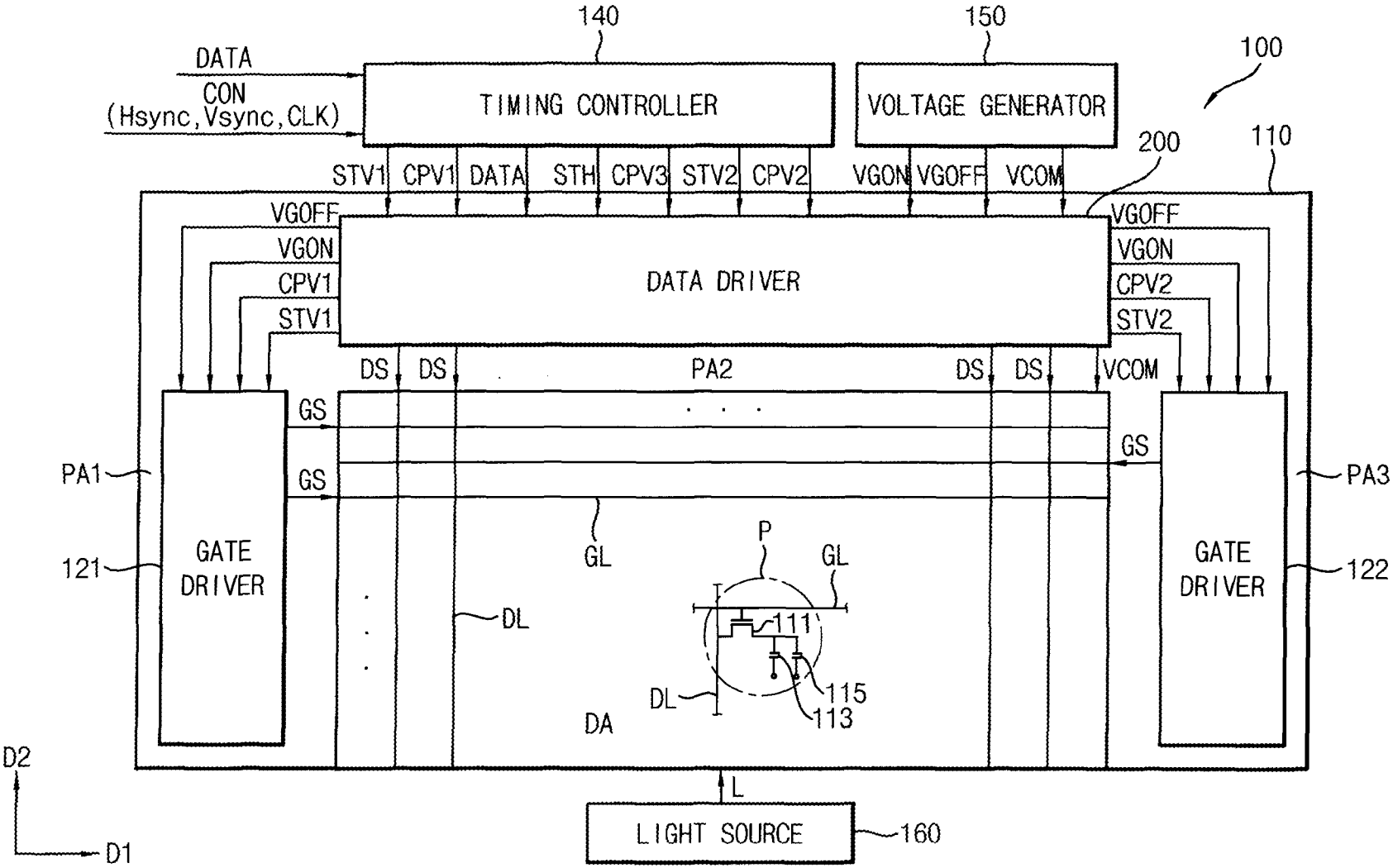
FIG. 1 is a block diagram illustrating a display apparatus according to exemplary embodiments of the present disclosure.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. In the drawings, the size and relative sizes of layers and regions may be exaggerated for clarity. Like reference numerals in the drawings denote like elements.

It will be understood that when an element or layer is referred to as being "on", "connected to", or "coupled to" another element or layer, it can be directly on, connected, or coupled to the other element or layer or intervening elements or layers may be present. In contrast, when an element is referred to as being "directly on", "directly connected to", or "directly coupled to" another element or layer, there are no intervening elements or layers present. As used herein, the term "and/or" includes any and all combinations of one or more of the associated listed items. It may also be understood that for the purposes of this disclosure, "at least one of X, Y, and Z" can be construed as X only, Y only, Z only, or any combination of two or more items X, Y, and Z (e.g., XYZ, XYY, YZ, ZZ).

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, or section from another region, layer or section. Thus, a first element, component, region, layer, or section discussed below could be termed a second element, component, region, layer, or section without departing from the teachings of the present disclosure.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing exemplary embodiments only and is not intended to be limiting of the disclosed subject matter. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the disclosed subject matter are described herein with reference to cross-section illustrations that are schematic illustrations of idealized embodiments (and intermediate structures) of the disclosed subject matter. As such, variations from the shapes of the illustrations as a result, for example, of manufacturing techniques and/or tolerances, are to be expected. Thus, exemplary embodiments of the disclosed subject matter should not be construed as limited to the particular shapes of regions illustrated herein but are to include deviations in shapes that result, for example, from manufacturing.

Hereinafter, exemplary embodiments of the disclosed subject matter will be described in detail with reference to the accompanying drawings.

FIG. 1 is a block diagram illustrating a display apparatus according to exemplary embodiments of the present disclosure.

Referring to FIG. 1, the display apparatus 100 may include a display panel 110, a first gate driver 121, a second gate driver 122, a data driver 200, a timing controller 140, a voltage generator 150, and a light source 160.

The display panel 110 may include a display area DA, a first peripheral area PA1, a second peripheral area PA2, and a third peripheral area PA3.

The display area DA of the display panel 110 may receive a data signal DS based on image data DATA to display an image. In some cases, the image data DATA may be two-dimensional plane image data. In some cases, the image data DATA may include a left-eye image data and a right-eye image data for displaying a three-dimensional stereoscopic image.

The display area DA of the display panel 110 may include gate lines GL, data lines DL, and a plurality of pixels P. The gate lines GL extend in a first direction D1 and the data lines DL extend in a second direction D2 substantially perpendicular to the first direction D1. The first direction D1 may be parallel with a long side of the display panel 110, and the second direction D2 may be parallel with a short side of the display panel 110. Each of the pixels P may include a thin film transistor 111 electrically connected to the gate line GL and the data line DL, a liquid crystal capacitor 113, and a storage capacitor 115 connected to the thin film transistor 111.

The first peripheral area PA1 is disposed at a peripheral area of the display area DA adjacent to one terminal of the gate lines GL. The first peripheral area PA1 may include the first gate driver 121. The first gate driver 121 may generate a gate signal GS in response to a first gate start signal STV1 and a first gate clock signal CPV1 generated by the timing controller 140 and transferred through the data driver 200. The first gate driver 121 may output the gate signal GS to the gate line GL. For example, the first gate driver 121 may output the gate signals GS to odd-numbered gate lines GL of the gate lines GL.

The third peripheral area PA3 may be disposed at a peripheral area of the display area DA adjacent to another terminal of the gate line GL, and the third peripheral area PA3 may include the second gate driver 122. The second gate driver 122 may generate a gate signal GS in response to the second gate start signal STV2 and the second gate clock signal CPV2 generated by the timing controller 140 and transferred through the data driver 200. The second gate driver 122 may output the gate signal GS to the data line GL. For example, the second gate driver 122 may output the gate signals GS to even-numbered gate lines GL of the gate lines GL.

The second peripheral area PA2 may be disposed at a peripheral area of the display area DA adjacent to a terminal of the data line DL, and the second peripheral area PA2 may include the data driver 200. The data driver 200 may output the data signal DS based on the image data DATA, in response to a data start signal STH and a data clock signal CPV3 provided from the timing controller 140.

In FIG. 1, the first gate driver 121, the second gate driver 122 and the data driver 200 are disposed on the display panel 110, but exemplary embodiments are not limited thereto. For example, at least one of the first gate driver 121, the second gate driver 122 and the data driver 200 may be disposed outside of the display panel 110.

Figure 2:
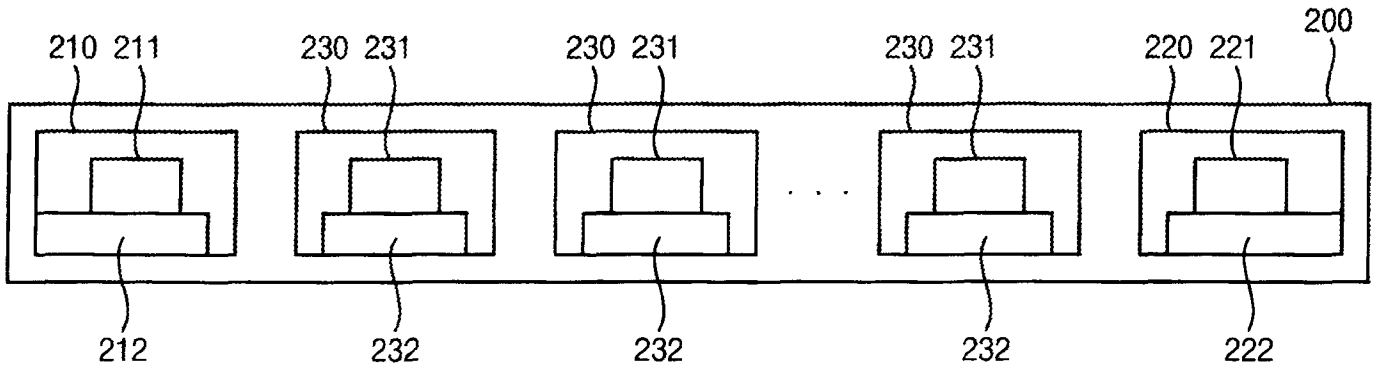
FIG. 2 is a block diagram illustrating a data driver of FIG. 1.

FIG. 2 is a block diagram illustrating the data driver 200 of FIG. 1.

Referring to FIGS. 1 and 2, the data driver 200 includes a first data driving circuit 210, a second data driving circuit 220, and a third data driving circuit 230. In some cases, the first data driving circuit 210 and the second data driving circuit 220 may be referred to as a first data driver, and the third data driving circuit 230 may be referred to as a second data driver.

The first data driving circuit 210 may be adjacent to a first data line of the data lines DL, the second data driving circuit 220 may be adjacent to a last data line of the data lines DL, and a plurality of the third data driving circuits 230 may be disposed between the first data driving circuit 210 and the second data driving circuit 220.

The first data driving circuit 210 may include a first data driving integrated circuit 211 and a first pad portion 212. The first data driving integrated circuit 211 may generate a data signal DS. The data signal DS generated from the first data driving integrated circuit 211 may be a first data signal. The first pad portion 212 may output the first data signal generated from the first data driving integrated circuit 211 to the data line DL.

The second data driving circuit 220 may include a second data driving integrated circuit 221 and a second pad portion 222. The second data driving integrated circuit 221 may generate a data signal DS. The data signal DS generated from the second data driving integrated circuit 221 may be a second data signal. The second pad portion 222 may output the second data signal generated from the second data driving integrated circuit 221 to the data line DL.

The third data driving circuits 230 may be disposed between the first data driving circuit 210 and the second data driving circuit 220. Each of the third data driving circuits 230 may include a third data driving integrated circuit 231 and a third pad portion 232. The third data driving integrated circuit 231 may generate a data signal DS. The data signal DS generated from the third data driving integrated circuit 231 may be a third data signal. The third pad portion 232 may output the third data signal generated from the third data driving integrated circuit 231 to the data line DL.

Figure 3:
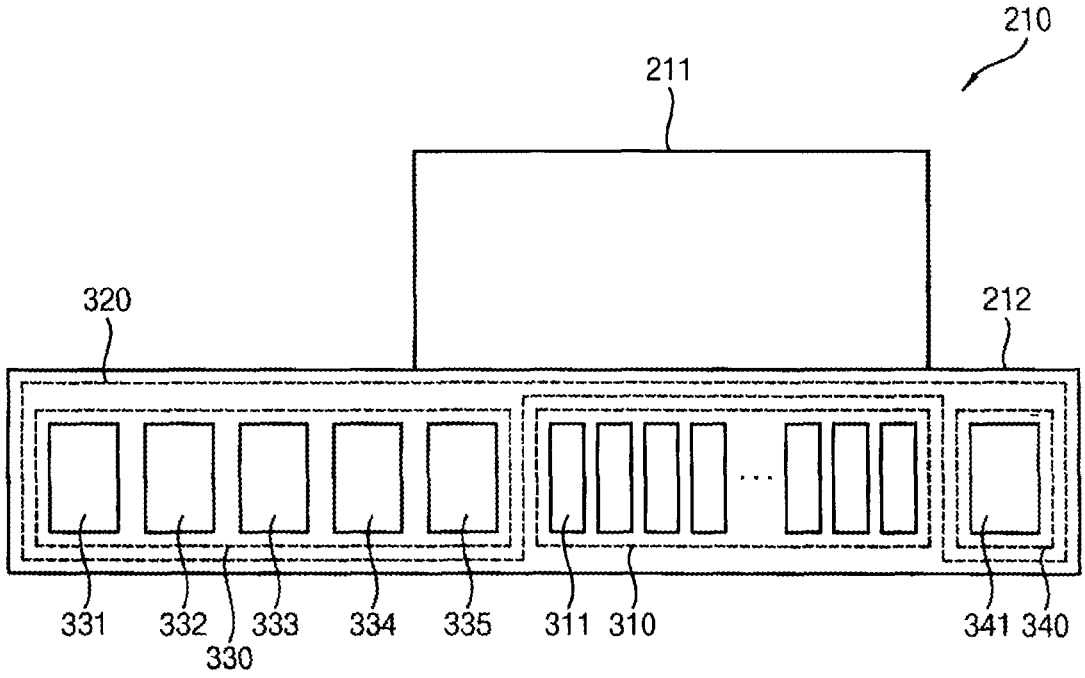
FIG. 3 is a block diagram illustrating a first data driving circuit of FIG. 2.

FIG. 3 is a block diagram illustrating the first data driving circuit 210 of FIG. 2.

Referring to FIGS. 1, 2, and 3, the first data driving circuit 210 includes the first data driving integrated circuit 211 and the first pad portion 212. The first data driving integrated circuit 211 may generate the first data signal. The first pad portion 212 may include a first data pad portion 310 and a first peripheral pad portion 320.

The first data pad portion 310 may include a plurality of first data pads 311. The first data pads 311 may output the first data signals generated from the first data driving integrated circuit 211 to the data lines DL.

The first peripheral pad portion 320 may be disposed on at least two sides of the first data pad portion 310. For example, the first peripheral pad portion 320 may include a first one side peripheral pad portion 330 disposed at one side of the first data pad portion 310, and a first second side peripheral pad portion 340 disposed at another side of the first data pad portion 310 opposite to the one side of the first data pad portion 310.

The first one side peripheral pad portion 330 may be adjacent to the first gate driver 121 from the first data pad portion 310, and may output a first gate driving signal to drive the first gate driver 121. The first one side peripheral pad portion 330 may include a first gate start signal pad 331 to output the first gate start signal STV1, a first gate clock signal pad 332 to output the first gate clock signal CPV1, a gate on voltage pad 333 to output a gate on voltage VGON to the first gate driver 121, a gate off voltage pad 334 to output a gate off voltage VGOFF to the first gate driver 121, and a common voltage pad 335 to output a common voltage VCOM to the display panel 110.

The first second side peripheral pad portion 340 may include a common voltage pad 341 to output the common voltage VCOM to the display panel 110. The common voltage VCOM may be set to any suitable voltage by a manufacturer of the display panel 110.

Figure 4:
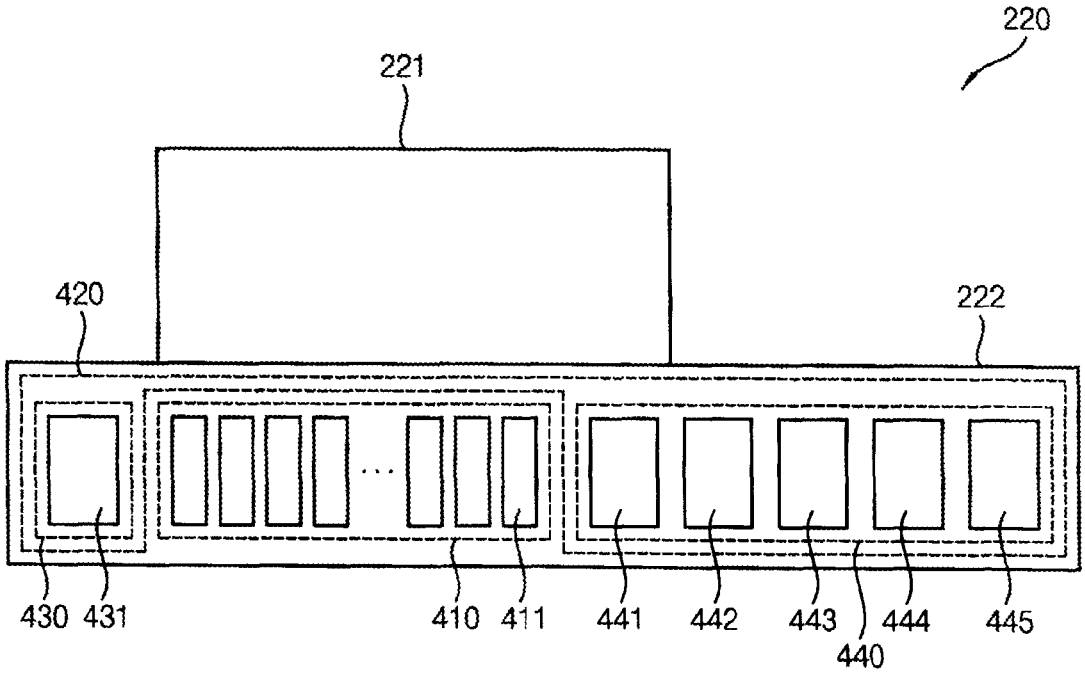
FIG. 4 is a block diagram illustrating a second data driving circuit of FIG. 2.

FIG. 4 is a block diagram illustrating the second data driving circuit 220 of FIG. 2.

Referring to FIGS. 1, 2, and 4, the second data driving circuit 220 may include the second data driving integrated circuit 221 and the second pad portion 222. The second data driving integrated circuit 221 may generate the second data signal. The second pad portion 222 may include a second data pad portion 410 and a second peripheral pad portion 420.

The second data pad portion 410 may include a plurality of second data pads 411. The second data pads 411 may output the second data signals generated from the second data driving integrated circuit 221 to the data lines DL.

The second peripheral pad portion 420 may be disposed on at least two sides of the second data pad portion 410. For example, the second peripheral pad portion 420 may include a second one side peripheral pad portion 430 disposed at one side of the second data pad portion 410 toward the third data driving circuit 230, and a second second side peripheral pad portion 440 disposed at another side of the second data pad portion 410 opposite to the one side of the second data pad portion 410.

The second one side peripheral pad portion 430 may include a common voltage pad 431 to output the common voltage VCOM to the display panel 110. The common voltage VCOM may be set to any suitable voltage by a manufacturer of the display panel 110.

The second second side peripheral pad portion 440 may be adjacent to the second gate driver 122 from the second data pad portion 410, and may output a second gate driving signal to drive the second gate driver 122. The second second side peripheral pad portion 440 may include a second gate start signal pad 441 to output the second gate start signal STV2, a second gate clock signal pad 442 to output the second gate clock signal CPV2, a gate on voltage pad 443 to output the gate on voltage VGON to the second gate driver 122, a gate off voltage pad 444 outputting the gate off voltage VGOFF to the second gate driver 122, and a common voltage pad 445 to output the common voltage VCOM to the display panel 110.

Figure 5:
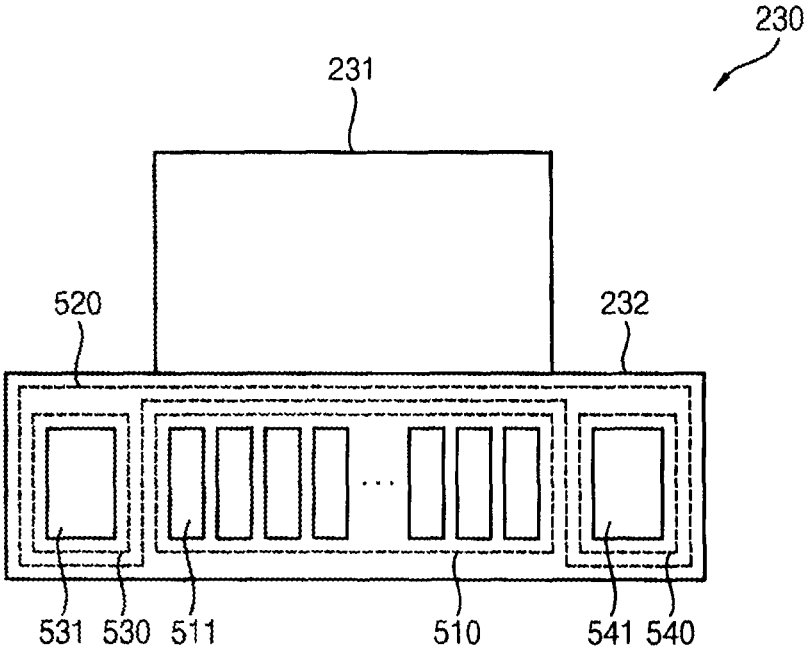
FIG. 5 is a block diagram illustrating a third data driving circuit of FIG. 2.

FIG. 5 is a block diagram illustrating the third data driving circuit 230 of FIG. 2.

Referring to FIGS. 1, 2 and 5, the third data driving circuit 230 may include the third data driving integrated circuit 231 and the third pad portion 232. The third data driving integrated circuit 231 may generate the third data signal. The third pad portion 232 may include a third data pad portion 510 and a plurality of third peripheral pad portions 520.

The third pad portion 510 may include a plurality of third data pads 511. The third data pads 511 may output the third data signals generated from the third data driving integrated circuit 231 to the data lines DL.

The third peripheral pad portion 520 may be disposed on at least two sides of the third data pad portion 510. For example, the third peripheral pad portion 520 may include a third one side peripheral pad portion 530 disposed at one side of the third data pad portion 510 toward the first data driving circuit 210, and a third second side peripheral pad portion 540 disposed at another side of the third data pad portion 510 opposite to the one side of the third data pad portion 510.

The third one side peripheral pad portion 530 may include a common voltage pad 531 to output the common voltage VCOM to the display panel 110. The common voltage VCOM may be set to any suitable voltage by a manufacturer of the display panel 110.

The third second side peripheral pad portion 540 may include a common voltage pad 541 to output the common voltage VCOM to the display panel 110.

Each of the common voltage pad 335 and the common voltage pad 341 in the first data driving circuit 210 may be referred to as a first common voltage pad; each of the common voltage pad 431 and the common voltage pad 445 in the second data driving circuit 220 may be referred to as a second common voltage pad, and each of the common voltage pad 531 and the common voltage pad 541 in the third data driving circuit 230 may be referred to as a third common voltage pad.

Referring back to FIG. 1, the timing controller 140 may receive image data DATA and a control signal CON from an external source. The control signal CON may include a horizontal synchronous signal Hsync, a vertical synchronous signal Vsync, and a clock signal CLK. The timing controller 140 may generate the data start signal STH using the horizontal synchronous signal Hsync, and may output the data start signal STH to the data driver 200. In addition, the timing controller 140 may generate the first gate start signal STV1 using the vertical synchronous signal Vsync, and may output the first gate start signal STV1 to the first gate driver 121. In addition, the timing controller 140 may generate the second gate start signal STV2 using the vertical synchronous signal Vsync, and may output the second gate start signal STV2 to the second gate driver 122. In addition, the timing controller 140 may generate the first gate clock signal CPV1, the second gate clock signal CPV2, and the data clock signal CPV3 using the clock signal CLK. The data clock signal CPV3 may be provided to the data driver 200. The timing controller 140 may provide, via the data driver 200, the first gate clock signal CPV1 to the first gate driver 121 and the second gate clock signal CPV2 to the second gate driver 122.

The voltage generator 150 may generate the gate on voltage VGON, the gate off voltage VGOFF, and the common voltage VCOM, and provide the generated voltages VGON, VGOFF, and VCOM to the data driver 200.

The light source 160 may provide light L to the display panel 110. In some cases, the light source 160 may include a light emitting diode (LED).

Referring to FIG. 5 again, the third peripheral pad portion 520 in the third data driving circuit 230 includes the common voltage pads 531 and 541 without a gate driving signal pad outputting a gate driving signal. Therefore, a distance between the third data pads 511 included in the third data pad portion 510 may be increased. Thus, a pitch of the third data pads 511 may be increased. Consequently, a slope of data fan-out lines, which are disposed between the third data pads 511 and the data lines DL and transfer the data signals DS, with respect to the data lines DL may be decreased. The data fan-out lines and the data lines DL may be substantially parallel, and thus lengths of the data fan-out lines may be decreased.

Referring to FIG. 3, the first second side peripheral pad portion 340 may include the common voltage pad 341 without a gate driving signal pad outputting a gate driving signal. Therefore, a distance between the first data pads 311 included in the first data pad portion 310 may be increased. Thus, a pitch of the first data pads 311 may be increased. Consequently, a slope of data fan-out lines, which are disposed between the first data pads 311 and the data lines DL and transfer the data signals DS, with respect to the data lines DL may be decreased. The data fan-out lines and the data lines DL may be substantially parallel, and thus lengths of the data fan-out lines may be decreased.

Referring to FIG. 4, the second one side peripheral pad portion 430 may include the common voltage pad 431 without a gate driving signal pad outputting a gate driving signal. Therefore, a distance between the second data pads 411 included in the second data pad portion 410 may be increased. Thus, a pitch of the second data pads 411 may be increased. Consequently, a slope of data fan-out lines, which are disposed between the second data pads 411 and the data lines DL and transfer the data signals DS, with respect to the data lines DL may be decreased. The data fan-out lines and the data lines DL may be substantially parallel, and thus lengths of the data fan-out lines may be decreased.

Because the lengths of the data fan-out lines are decreased, a black matrix area where a black matrix is formed in the display panel 110 may be decreased, and thus a width of a bezel of the display apparatus 100 may also be decreased.

Figure 6:
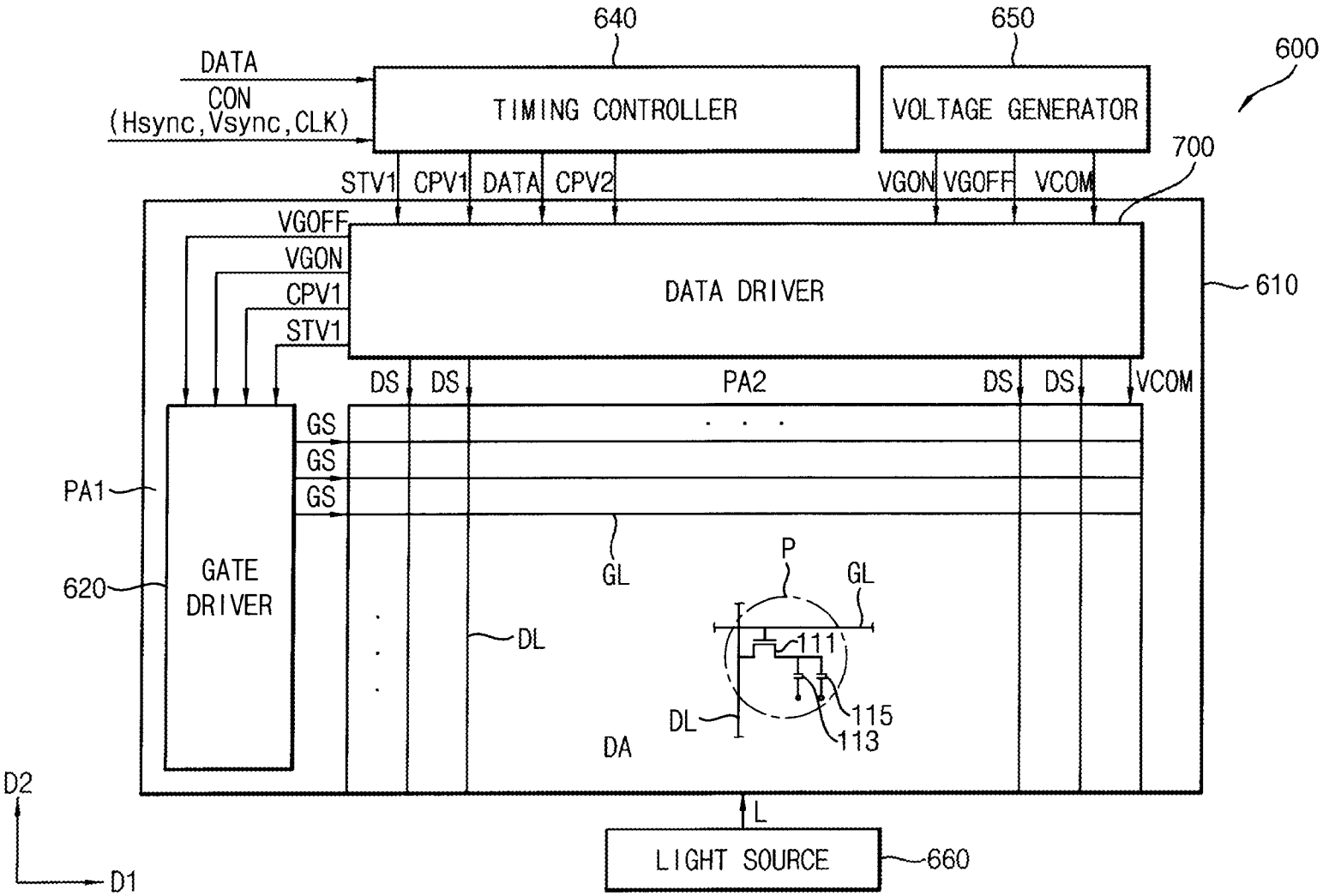
FIG. 6 is a block diagram illustrating a display apparatus according to exemplary embodiments of the present disclosure.

FIG. 6 is a block diagram illustrating a display apparatus according to exemplary embodiments of the present disclosure.

Referring to FIG. 6, the display apparatus 600 may include a display panel 610, a gate driver 620, a data driver 700, a timing controller 640, a voltage generator 650, and a light source 660.

The display panel 610 may include a display area DA, a first peripheral area PA1, and a second peripheral area PA2.

The display area DA of the display panel 610 may receive a data signal DS based on image data DATA to display an image. In some cases, the image data DATA may be a two-dimensional plane image data. In some cases, the image data DATA may include a left-eye image data and a right-eye image data for displaying a three-dimensional stereoscopic image.

The display area DA of the display panel 610 may include gate lines GL, data lines DL, and a plurality of pixels P. The gate lines GL extend in a first direction D1, and the data lines DL extend in a second direction D2 substantially perpendicular to the first direction D1. The first direction D1 may be parallel with a long side of the display panel 610, and the second direction D2 may be parallel with a short side of the display panel 610. Each of the pixels P includes a thin film transistor 111 electrically connected to one of the gate lines GL, one of the data lines DL, a liquid crystal capacitor 113, and a storage capacitor 115 connected to the thin film transistor 111.

The first peripheral area PA1 may be disposed at a peripheral area of the display area DA adjacent to one terminal of the gate line GL, and the first peripheral area PA1 may include the gate driver 620. The gate driver 620 may generate a gate signal GS in response to a gate start signal STV and a gate clock signal CPV1 provided by the timing controller 640 via the data driver 700. The gate driver 620 may output the gate signal GS to the gate line GL.

The second peripheral area PA2 may be disposed at a peripheral area of the display area DA adjacent to one terminal of the data line DL, and the second peripheral area PA2 may include the data driver 700. The data driver 700 may output the data signal DS based on the image data DATA, in response to a data start signal STH and a data clock signal CPV2 provided from the timing controller 640.

The gate driver 620 and the data driver 700 may be disposed in the display panel 610, but are not limited thereto. For example, in some cases, at least one of the gate driver 620 and the data driver 700 may be disposed outside the display panel 110.

Figure 7:
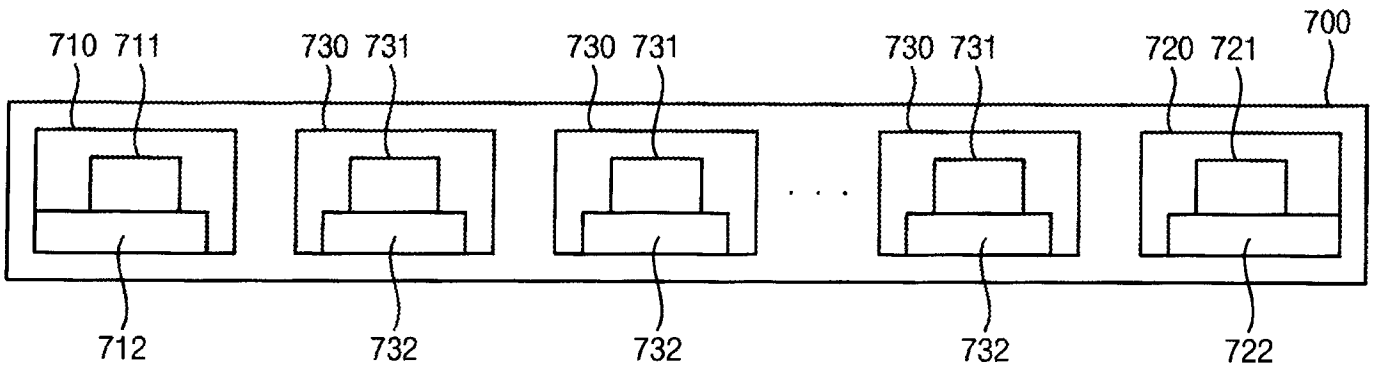
FIG. 7 is a block diagram illustrating a data driver of FIG. 6.

FIG. 7 is a block diagram illustrating the data driver 700 of FIG. 6.

Referring to FIGS. 6 and 7, the data driver 700 may include a first data driving circuit 710, a second data driving circuit 720, and third data driving circuits 730. The first data driving circuit 710 and the second data driving circuit 720 may be referred to as a first data driver, and the third data driving circuit 730 may be referred to as a second data driver.

The first data driving circuit 710 may be adjacent to a first data line of the data lines DL, the second data driving circuit 720 may be adjacent to a last data line of the data lines DL, and the third data driving circuits 730 may be disposed between the first data driving circuit 710 and the second data driving circuit 720.

The first data driving circuit 710 may include a first data driving integrated circuit 711 and a first pad portion 712. The first data driving integrated circuit 711 may generate a data signal DS. The data signal DS generated from the first data driving integrated circuit 711 may be a first data signal. The first pad portion 712 may output the first data signal generated from the first data driving integrated circuit 711 to the data lines DL.

The second data driving circuit 720 may include a second data driving integrated circuit 721 and a second pad portion 722. The second data driving integrated circuit 721 may generate a data signal DS. The data signal DS generated from the second data driving integrated circuit 721 may be a second data signal. The second pad portion 722 may output the second data signal generated from the second data driving integrated circuit 721 to the data lines DL.

The third data driving circuits 730 may be disposed between the first data driving circuit 710 and the second data driving circuit 720. Each of the third data driving circuits 730 include a third data driving integrated circuit 731 and a third pad portion 732. The third data driving integrated circuit 731 generates a data signal DS. The data signal DS generated from the third data driving integrated circuit 731 may be a third data signal. The third pad portion 732 may output the third data signal generated from the third data driving integrated circuit 731 to the data lines DL.

Figure 8:
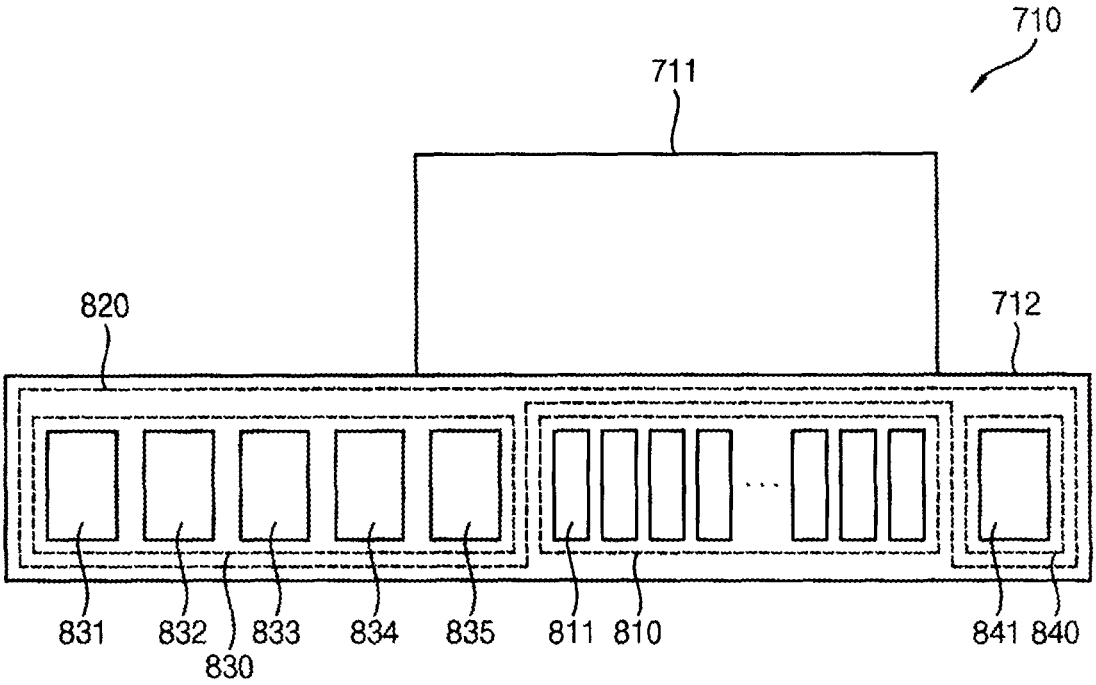
FIG. 8 is a block diagram illustrating a first data driving circuit of FIG. 7.

FIG. 8 is a block diagram illustrating the first data driving circuit 710 of FIG. 7.

Referring to FIGS. 6, 7, and 8, the first data driving circuit 710 may include the first data driving integrated circuit 711 and the first pad portion 712. The first data driving integrated circuit 711 may generate the first data signal. The first pad portion 712 may include a first data pad portion 810 and a first peripheral pad portion 820.

The first data pad portion 810 may include a plurality of first data pads 811. The first data pads 811 may output the first data signals generated from the first data driving integrated circuit 711 to the data lines DL.

The first peripheral pad portion 820 may be disposed on at least two sides of the first data pad portion 810. For example, the first peripheral pad portion 820 may include a first one side peripheral pad portion 830 disposed at one side of the first data pad portion 810, and a first second side peripheral pad portion 840 disposed at another side of the first data pad portion 810 opposite to the one side of the first data pad portion 810.

The first one side peripheral pad portion 830 may be adjacent to the gate driver 620 from the first data pad portion 810, and may output a gate driving signal driving the gate driver 620. The first one side peripheral pad portion 830 may include a gate start signal pad 831 to output the gate start signal STV, a gate clock signal pad 832 to output the gate clock signal CPV1, a gate on voltage pad 833 to output a gate on voltage VGON to the gate driver 620, a gate off voltage pad 834 to output a gate off voltage VGOFF to the gate driver 620, and a common voltage pad 835 to output a common voltage VCOM to the display panel 610.

The first second side peripheral pad portion 840 may include a common voltage pad 841 to output the common voltage VCOM to the display panel 610. The common voltage VCOM may be set to any suitable voltage by a manufacturer of the display panel 610.

Figure 9:
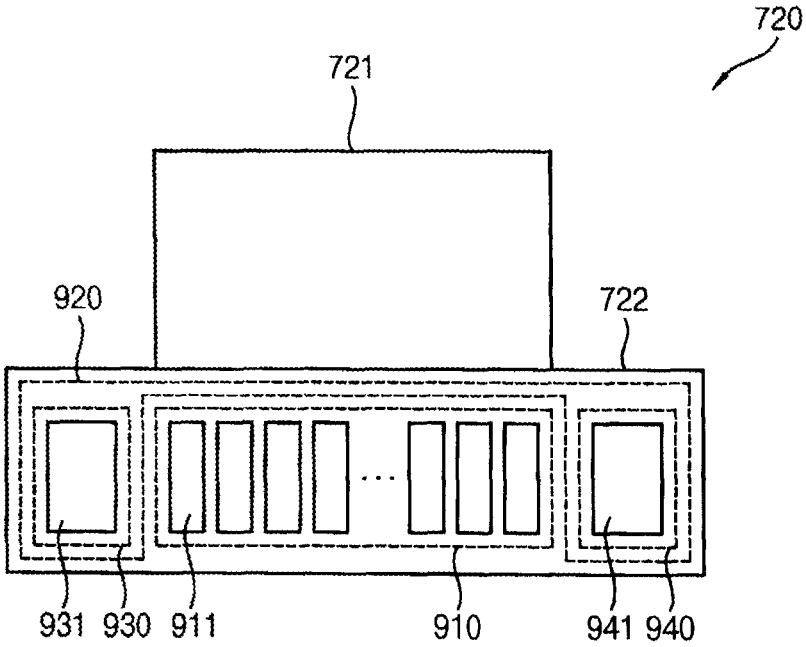
FIG. 9 is a block diagram illustrating a second data driving circuit of FIG. 7.

FIG. 9 is a block diagram illustrating the second data driving circuit 720 of FIG. 7.

Referring to FIGS. 6, 7, and 9, the second data driving circuit 720 may include the second data driving integrated circuit 721 and the second pad portion 722. The second data driving integrated circuit 721 may generate the second data signal. The second pad portion 722 may include a second data pad portion 910 and a second peripheral pad portion 920.

The second data pad portion 910 may include a plurality of second data pads 911. The second data pads 911 may output the second data signals generated from the second data driving integrated circuit 721 to the data lines DL.

The second peripheral pad portion 920 may be disposed on at least two sides of the second data pad portion 910. The second peripheral pad portion 920 may include a second one side peripheral pad portion 930 disposed at one side of the second data pad portion 910 toward the third data driving circuit 730, and a second second side peripheral pad portion 940 disposed at another side of the second data pad portion 910 opposite to the one side of the second data pad portion 910.

The second one side peripheral pad portion 930 may include a common voltage pad 931 to output the common voltage VCOM to the display panel 610.

The second second side peripheral pad portion 940 may include a common voltage pad 941 to output the common voltage VCOM to the display panel 610. The common voltage VCOM may be set to any suitable voltage by a manufacturer of the display panel 610.

Figure 10:
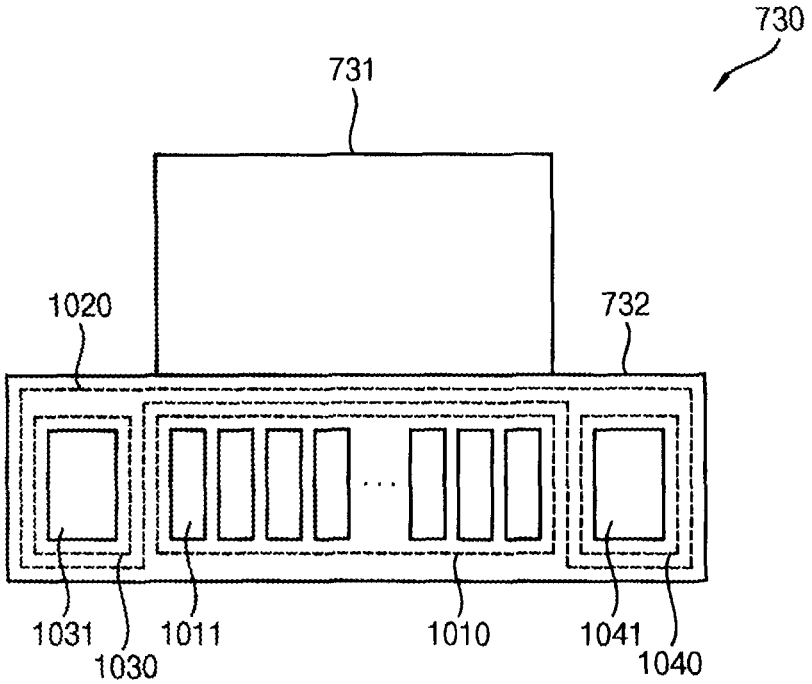
FIG. 10 is a block diagram illustrating a third data driving circuit of FIG. 7.

FIG. 10 is a block diagram illustrating the third data driving circuit 730 of FIG. 7.

Referring to FIGS. 6, 7, and 10, the third data driving circuit 730 may include the third data driving integrated circuit 731 and the third pad portion 732. The third data driving integrated circuit 731 may generate the third data signal. The third pad portion 732 may include a third data pad portion 1010 and a third peripheral pad portion 1020.

The third pad portion 1010 may include a plurality of third data pads 1011. The third data pads 1011 may output the third data signals generated from the third data driving integrated circuit 731 to the data lines DL.

The third peripheral pad portion 1020 may be disposed on at least two sides of the third data pad portion 1010. The third peripheral pad portion 1020 may include a third one side peripheral pad portion 1030 disposed at one side of the third data pad portion 1010 toward the first data driving circuit 710, and a third second side peripheral pad portion 1040 disposed at another side of the third data pad portion 1010 opposite to the one side of the third data pad portion 1010.

The third one side peripheral pad portion 1030 may include a common voltage pad 1031 to output the common voltage VCOM to the display panel 610.

The third second side peripheral pad portion 1040 may include a common voltage pad 1041 to output the common voltage VCOM to the display panel 610. The common voltage VCOM may be set to any suitable voltage by a manufacturer of the display panel 610.

Referring to FIGS. 8, 9, and 10, each of the common voltage pad 831 and the common voltage pad 841 in the first data driving circuit 710 may be referred to as a first common voltage pad; each of the common voltage pad 931 and the common voltage pad 941 in the second data driving circuit 720 may be referred to as a second common voltage pad; and each of the common voltage pad 1031 and the common voltage pad 1041 in the third data driving circuit 730 may be referred to as a third common voltage pad.

Referring to FIG. 6, the timing controller 640 may receive image data DATA and a control signal CON from an external source. The control signal CON may include a horizontal synchronous signal Hsync, a vertical synchronous signal Vsync, and a clock signal CLK. The timing controller 640 may generate the data start signal STH using the horizontal synchronous signal Hsync, and may output the data start signal STH to the data driver 700. The timing controller 640 may generate the gate start signal STV using the vertical synchronous signal Vsync, and may output the gate start signal STV to the gate driver 620. The timing controller 640 may generate the gate clock signal CPV1 and the data clock signal CPV2 using the clock signal CLK, and may output the gate clock signal CPV1 to the gate driver 620 and the data clock signal CPV2 to the data driver 700.

The voltage generator 650 may output the gate on voltage VGON, the gate off voltage VGOFF, and the common voltage VCOM to the data driver 700.

The light source 660 may provide light L to the display panel 610. In some cases, the light source 660 may include a light emitting diode (LED).

The third peripheral pad portion 1020 in the third data driving circuit 730 may include the common voltage pads 1031 and 1041 without a gate driving signal pad to output a gate driving signal. Therefore, a distance between the third data pads 1011 in the third data pad portion 1010 may be increased. Consequently, a pitch of the third data pads 1011 may be increased. Therefore, a slope of data fan-out lines, which are disposed between the third data pads 1011 and the data lines DL and transfer the data signals DS, with respect to the data lines DL may be decreased. The data fan-out lines and the data lines DL may be substantially parallel, and thus lengths of the data fan-out lines may be decreased.

Referring to FIG. 8, the first second side peripheral pad portion 840 may include the common voltage pad 841 without a gate driving signal pad to output the gate driving signal. Therefore a distance between the first data pads 811 in the first data pad portion 810 may be increased. Consequently, a pitch of the first data pads 811 may be increased. Therefore, a slope of data fan-out lines, which are disposed between the first data pads 811 and the data lines DL and transfer the data signals DS, with respect to the data lines DL may be decreased. The data fan-out lines and the data lines DL may be substantially parallel, and thus lengths of the data fan-out lines may be decreased.

Referring to FIG. 9, the second peripheral pad portion 920 included in the second data driving circuit 720 may include the common voltage pads 931 and 941 without a gate driving signal pad to output the gate driving signal. Therefore, a distance between the second data pads 911 in the second data pad portion 910 may be increased. Consequently, a pitch of the second data pads 911 may be increased. Therefore, a slope of data fan-out lines, which are disposed between the second data pads 911 and the data lines DL and transfer the data signals DS, with respect to the data lines DL may be decreased. The data fan-out lines and the data lines DL may be substantially parallel, and thus lengths of the data fan-out lines may be decreased.

Since the lengths of the data fan-out lines are decreased, a black matrix area where a black matrix is formed in the display panel 610 may be decreased, and a width of a bezel of the display apparatus 600 may be decreased.

According to the data driving apparatus and the display apparatus having the data driving apparatus described hereinabove, lengths of data fan-out lines, which are disposed between data pads and data lines and transfer data signals, may be decreased, and thus a width of a bezel of the display apparatus may be decreased.

The foregoing is illustrative of the disclosed subject matter, and is not to be construed as limiting thereof. Although a few exemplary embodiments of the present disclosure have been described, those skilled in the art will readily appreciate that many modifications are possible in the exemplary embodiments without materially departing from the novel teachings and advantages of the present disclosure. Accordingly, all such modifications are intended to be included within the scope of the present disclosure as defined in the claims. It is to be understood that the foregoing is illustrative of the present disclosure and is not to be construed as limited to the specific exemplary embodiments disclosed, and that modifications to the disclosed exemplary embodiments, as well as other exemplary embodiments, are intended to be included within the scope of the appended claims.

What is claimed is:

1. A data driving apparatus, comprising:

at least one first data driver comprising:

data pads to provide first data signals to data lines of a display panel;

at least one first common voltage pad to provide a common voltage to the display panel; and a gate driving signal pad to provide a gate driving signal to a gate driver configured to provide a gate signal to a gate line of the display panel; and at least one second data driver to provide a second data signal to the data lines, the at least one second data driver comprising at least one second common voltage pad to provide the common voltage to the display panel, wherein:

the at least one first data driver comprises a first data driving circuit adjacent to a first terminal of the gate line;

the first data driving circuit comprises:

a first data driving integrated circuit to provide the first data signals;

a first data pad portion comprising a first data pad disposed between the first data driving integrated circuit and the data lines, the first data pad portion to provide the first data signals; and a first peripheral pad portion comprising a first gate driving signal pad to output a first gate driving signal to a first gate driver disposed at a first peripheral area adjacent to the first terminal of the gate line;

the first peripheral pad portion comprises:

a first one side peripheral pad portion disposed at a first side of the first data pad portion and comprising the first gate driving signal pad; and a first second side peripheral pad portion disposed at a second side of the first data pad portion opposite to the first side of the first data pad portion, the first second side peripheral pad portion comprising a first of the at least one first common voltage pad to provide the common voltage to the display panel; and the first one side peripheral pad portion further comprises a second of the at least one first common voltage pad to provide the common voltage to the display panel.

2. The data driving apparatus of claim 1, wherein the first gate driving signal pad is disposed at a side of the first data pad portion facing the first gate driver.

3. The data driving apparatus of claim 1, wherein the first gate driving signal comprises a first gate start signal and a first gate clock signal.

4. The data driving apparatus of claim 3, wherein the first gate driving signal pad comprises a first gate start signal pad to provide the first gate start signal, and a first gate clock signal pad to output the first gate clock signal.

5. The data driving apparatus of claim 4, wherein the first gate driving signal pad further comprises a gate on voltage pad to provide a gate on voltage to the first gate driver, and a gate off voltage pad to provide a gate off voltage to the first gate driver.

6. The data driving apparatus of claim 1, wherein:

the at least one first data driver further comprises a second data driving circuit adjacent to a second terminal of the gate line opposite to the one terminal of the gate line; and the second data driving circuit comprises:

a second data driving integrated circuit to provide a second data signal, a second data pad portion comprising a second data pad disposed between the second data driving integrated circuit and the data lines, the second data pad portion to provide the second data signal, and a second peripheral pad portion comprising at least one third common voltage pad to provide the common voltage to the display panel.

7. The data driving apparatus of claim 6, wherein the second peripheral pad portion comprises:

a second one side peripheral pad portion disposed at a first side of the second data pad portion and comprising a first of the at least one third common voltage pad to provide the common voltage to the display panel; and a second second side peripheral portion disposed at a second side of the second data pad portion opposite to the first side of the second data pad portion, the second second side peripheral portion comprising a second of the at least one third common voltage pad to provide the common voltage to the display panel.

8. The data driving apparatus of claim 6, wherein the second peripheral pad portion further comprises a second gate driving signal pad to provide a second gate driving signal to a second gate driver disposed at a second peripheral area adjacent to the second terminal of the gate line.

9. The data driving apparatus of claim 8, wherein the second gate driving signal pad is disposed at a second side of the second data pad portion toward the second gate driver.

10. The data driving apparatus of claim 8, wherein the second gate driving signal comprises a second gate start signal and a second gate clock signal.

11. The data driving apparatus of claim 10, wherein the second gate driving signal pad comprises a second gate start signal pad to provide the second gate start signal, and a second gate clock signal pad to provide the second gate clock signal.

12. The data driving apparatus of claim 11, wherein the second gate driving signal pad further comprises a gate on voltage pad to provide a gate on voltage to the second gate driver, and a gate off voltage pad to provide a gate off voltage to the second gate driver.

13. The data driving apparatus of claim 6, wherein:

the at least one second data driver comprises a third data driving circuit disposed between the first data driving circuit and the second data driving circuit; and the third data driving circuit comprises:

a third data driving integrated circuit to generate a third data signal, a third data pad portion comprising a third data pad disposed between the third data driving integrated circuit and the data lines, the third data pad portion to provide the third data signal, and a third peripheral pad portion comprising the at least one second common voltage pad to provide the common voltage to the display panel.

14. The data driving apparatus of claim 13, wherein the third peripheral pad portion comprises:

a third one side peripheral pad portion disposed at a first side of the third data pad portion toward the first data driving circuit from the third data pad portion, the third one side peripheral pad portion comprising a first of the at least one second common voltage pad to provide the common voltage to the display panel; and a third second side peripheral pad portion disposed at a second side of the third data pad portion opposite to the first side of the third data pad portion, the third second side peripheral pad portion comprising a second of the at least one second common voltage pad to provide the common voltage to the display panel.

15. A display apparatus, comprising:

a display panel to display an image;

a gate driver to provide a gate signal to a gate line of the display panel; and a data driving apparatus comprising:

at least one first data driver to provide first data signals to data lines of the display panel, the at least one first data driver comprising:

data pads to provide the first data signals;

at least one first common voltage pad to provide a common voltage to the display panel; and a gate driving signal pad to provide a gate driving signal to the gate driver; and at least one second data driver to provide second data signals to the data lines and comprising at least one second common voltage pad to provide the common voltage to the display panel, wherein:

the at least one first data driver comprises a first data driving circuit adjacent to a first terminal of the gate line;

the first data driving circuit comprises:

a first data driving integrated circuit to provide the first data signals;

a first data pad portion comprising a first data pad disposed between the first data driving integrated circuit and the data lines, the first data pad portion to provide the first data signals; and a first peripheral pad portion comprising a first gate driving signal pad to output a first gate driving signal to a first gate driver disposed at a first peripheral area adjacent to the first terminal of the gate line;

the first peripheral pad portion comprises:

a first one side peripheral pad portion disposed at a first side of the first data pad portion and comprising the first gate driving signal pad; and a first second side peripheral pad portion disposed at a second side of the first data pad portion opposite to the first side of the first data pad portion, the first second side peripheral pad portion comprising a first of the at least one first common voltage pad to provide the common voltage to the display panel; and the first one side peripheral pad portion further comprises a second of the at least one first common voltage pad to provide the common voltage to the display panel.

16. The display panel of claim 15, further comprising:

a timing controller to provide the gate driving signal to the data driving apparatus; and a voltage generator to provide the common voltage to the data driving apparatus.

17. The display panel of claim 15, wherein the gate driver and the data driver are disposed on the display panel.

* * * * *